US008747944B2

(12) United States Patent
Funahashi et al.

(10) Patent No.: US 8,747,944 B2
(45) Date of Patent: Jun. 10, 2014

(54) METHOD OF MANUFACTURING TRANSFER SHEET AND TRANSFER SHEET

(75) Inventors: Kazuki Funahashi, Kanagawa (JP); Kei Yasutomi, Tokyo (JP); Takuroh Sone, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/416,280

(22) Filed: Mar. 9, 2012

(65) Prior Publication Data

US 2012/0237698 A1 Sep. 20, 2012

(30) Foreign Application Priority Data

Mar. 18, 2011 (JP) ..... 2011-060145

(51) Int. Cl.
*B05D 5/04* (2006.01)
*B05D 1/38* (2006.01)

(52) U.S. Cl.
USPC ..... 427/152; 427/146; 427/258; 427/261; 427/288

(58) Field of Classification Search
USPC ..... 427/146, 152, 258, 261, 288
See application file for complete search history.

(56) References Cited

U.S. PATENT DOCUMENTS 4,464,453 A * 8/1984 Cooper et al. ..... 430/125.3
5,740,494 A 4/1998 Shoji et al.
5,999,773 A 12/1999 Yasutomi et al.
6,366,751 B1 4/2002 Shakuto et al.
6,597,885 B2 7/2003 Kai et al.
6,625,409 B2 9/2003 Shakuto et al.
6,654,579 B2 11/2003 Shakuto et al.
6,757,509 B2 6/2004 Shoji et al.
6,778,805 B2 8/2004 Kai et al.
6,800,410 B2 10/2004 Yasutomi et al.
6,819,901 B1 11/2004 Yasutomi et al.
6,879,416 B2 * 4/2005 Shimizu ..... 358/520
6,978,109 B2 12/2005 Shoji et al.
7,212,753 B2 5/2007 Suzuki et al.
7,463,837 B2 12/2008 Yasutomi
7,551,868 B2 6/2009 Yasutomi et al.
7,620,336 B2 11/2009 Yura et al.
7,657,218 B2 2/2010 Maruyama et al.
7,738,813 B2 6/2010 Yasutomi et al.
7,751,746 B2 7/2010 Miyawaki et al.
7,787,815 B2 8/2010 Nakamura et al.
7,822,351 B2 10/2010 Aoki et al.
8,126,346 B2 2/2012 Yura et al.
2002/0037187 A1 3/2002 Kai et al.

(Continued)

FOREIGN PATENT DOCUMENTS

JP 2001-030693 A 2/2001
JP 2001-239799 A 9/2001

(Continued)

*Primary Examiner* — Frederick Parker
(74) *Attorney, Agent, or Firm* — Harness, Dickey & Pierce, P.L.C.

(57) ABSTRACT

A method of manufacturing transfer sheet is provided. The method includes forming a colored toner image on a sheet-like base material based on objective image data. The sheet-like base material has releasability. The method further includes defining an image area on the sheet-like base material based on the objective image data. The image area includes the colored toner image. The method further includes forming a transparent toner layer on the image area. The method further includes forming an adhesive layer on the transparent toner layer. The adhesive layer has hot-melt property.

17 Claims, 10 Drawing Sheets

(56) References Cited

U.S. PATENT DOCUMENTS

| | | | | |
|---|---|---|---|---|
| 2002/0081128 | A1 | 6/2002 | Shakuto et al. | |
| 2002/0090229 | A1 | 7/2002 | Shakuto et al. | |
| 2002/0122675 | A1 | 9/2002 | Shoji et al. | |
| 2003/0049050 | A1 | 3/2003 | Shakuto et al. | |
| 2003/0063923 | A1 | 4/2003 | Yasutomi et al. | |
| 2003/0210938 | A1 | 11/2003 | Kai et al. | |
| 2003/0218665 | A1 | 11/2003 | Yasutomi et al. | |
| 2005/0152707 | A1 | 7/2005 | Suzuki et al. | |
| 2005/0254846 | A1 | 11/2005 | Yura et al. | |
| 2006/0188274 | A1 | 8/2006 | Yasutomi | |
| 2007/0031650 | A1 * | 2/2007 | Kobayashi et al. | 428/323 |
| 2008/0013975 | A1 | 1/2008 | Yasutomi et al. | |
| 2008/0056784 | A1 | 3/2008 | Nakamura et al. | |
| 2008/0056785 | A1 | 3/2008 | Maruyama et al. | |
| 2008/0118275 | A1 | 5/2008 | Yasutomi et al. | |
| 2008/0219702 | A1 | 9/2008 | Tsukamoto et al. | |
| 2008/0261768 | A1 | 10/2008 | Miyawaki et al. | |
| 2009/0003904 | A1 | 1/2009 | Yasutomi et al. | |
| 2009/0074431 | A1 | 3/2009 | Aoki et al. | |
| 2010/0002265 | A1 | 1/2010 | Yasutomi | |
| 2010/0021195 | A1 | 1/2010 | Yura et al. | |
| 2010/0215384 | A1 | 8/2010 | Yasutomi | |
| 2011/0206401 | A1 | 8/2011 | Sone et al. | |

FOREIGN PATENT DOCUMENTS

| | | | |
|---|---|---|---|
| JP | 2003-154793 | A | 5/2003 |
| JP | 2005-125292 | A | 5/2005 |
| JP | 2010-099940 | A | 5/2010 |

* cited by examiner

METHOD OF MANUFACTURING TRANSFER SHEET AND TRANSFER SHEET

CROSS-REFERENCE TO RELATED APPLICATIONS

This patent application is based on and claims priority pursuant to 35 U.S.C. §119 to Japanese Patent Application No. 2011-060145, filed on Mar. 18, 2011, in the Japanese Patent Office, the entire disclosure of which is hereby incorporated herein by reference.

BACKGROUND

1. Technical Field

The present disclosure relates to a method of manufacturing transfer sheet and a transfer sheet.

2. Description of Related Art

Transfer sheets have been widely used for printing images on materials such as clothes, ceramics, and plastics. A typical transfer sheet has a configuration such that a colorant layer including an objective image formed by an image forming apparatus, such as color laser printer or inkjet printer, is overlaid on a sheet-like base material having releasability, and an adhesive layer is further overlaid on the colorant layer. By bringing the adhesive layer of the transfer sheet into contact with a target medium, onto which the objective image is to be formed, upon application of pressure or heat, the objective image is transferred onto the target medium. The base material is peeled off from the target medium thereafter.

Various methods for manufacturing transfer sheet have been proposed so far. In some proposed methods, an adhesive layer is formed even on non-image image area. The adhesive layer formed on non-image area may undesirably deteriorate with time and disturb the color and gloss of the target medium. In particular, the adhesive layer formed on non-image area on clothes, such as T shirts, may undesirably give rough texture to the clothes.

Thus, in some proposed methods, an adhesive layer is removed from non-image area. For example, some methods propose to cut off non-image area from a transfer sheet using a cutting plotter. As another example, Japanese Patent Application Publication No. 2010-99940 proposes a method in which negative image is pressed against a positive image upon application of heat to obtain a transfer sheet from which non-image area is removed. As another example, Japanese Patent Application Publication No. 2010-99940 proposes a method in which negative image is pressed against a positive image upon application of heat to obtain a transfer sheet from which non-image area is removed.

When an objective image includes a high-lightness color portion formed of micro dots or a microscopic pattern, it may be technically difficult to precisely transfer the objective image onto a target medium. The reason is as follows.

FIG. 1 is a conceptional view of a dot structure in accordance with area coverage modulation. Typical electrophotographic image forming apparatuses employ area coverage modulation that expresses gradation by variations of dot size. A high-lightness color is formed of micro dots as illustrated in FIG. 1.

FIG. 2 is a cross-sectional view of a related-art transfer sheet having a high-lightness color toner image and an adhesive layer thereon. Referring to FIG. 2, in a related-art transfer sheet 11, a high-lightness color toner image 14 is formed on a release layer 22 of a release sheet 2 and an adhesive layer 16 is further formed on the high-lightness color toner image 14.

The high-lightness color toner image 14 is to be transferred onto a target medium by adhering the adhesive layer 16 to the target medium.

Since the contact area of the high-lightness color toner image 14 with the adhesive layer 16 is small, these layers may be weakly bind to each other. As a result, it is likely that the adhesive layer 16 is undesirably peeled off by external force and the high-lightness color toner image 14 is not reliably transferred onto the target medium.

Since the dot area of the high-lightness color toner image 14 is small, the area of the adhesive layer 16 is also small. As a result, the high-lightness color toner image 14 may be fixed on a target medium only weakly. When the release sheet 2 is peeled off after the transfer sheet 1 is pressed against the target medium upon application of heat and pressure, it is likely that a part of the high-lightness color toner image 14 remains on the release sheet 2 or that transferred onto the target medium easily peels off by external force.

When an objective image includes a high-lightness color portion formed of micro dots or a microscopic pattern, it may be technically difficult to precisely transfer the objective image onto a target medium.

SUMMARY

In accordance with some embodiments, a method of manufacturing transfer sheet is provided. The method includes forming a colored toner image on a sheet-like base material based on objective image data. The sheet-like base material has releasability. The method further includes defining an image area on the sheet-like base material based on the objective image data. The image area includes the colored toner image. The method further includes forming a transparent toner layer on the image area. The method further includes forming an adhesive layer on the transparent toner layer. The adhesive layer has hot-melt property.

In accordance with some embodiments, another method of manufacturing transfer sheet is provided. The method includes defining an image area on a sheet-like base material based on objective image data. The sheet-like base material has releasability. The method further includes forming a transparent toner layer on the image area, and forming a colored toner image on the transparent toner layer based on the objective image data. The method further includes forming an adhesive layer on the transparent toner layer and the colored toner image. The adhesive layer has hot-melt property.

In accordance with some embodiments, another method of manufacturing transfer sheet is provided. The method includes forming a colored toner image on a sheet-like base material based on objective image data. The sheet-like base material has releasability. The method further includes defining an image area on the sheet-like base material based on the objective image data. The image area includes the colored toner image. The method further includes forming a white toner layer on the image area. The method further includes forming an adhesive layer on the white toner layer. The adhesive layer has hot-melt property.

In accordance with some embodiments, a transfer sheet is provided. The transfer sheet includes a sheet-like base material having releasability, a colored toner image overlying the sheet-like base material, a transparent toner layer overlying an image area on the sheet-like base material, and an adhesive layer overlying the transparent toner layer. The image area includes the colored toner image. The adhesive layer has hot-melt property.

In accordance with some embodiments, another transfer sheet is provided. The transfer sheet includes a sheet-like base material having releasability, a transparent toner layer overlying an image area on the sheet-like base material, a colored toner image overlying the transparent toner layer; and an adhesive layer overlying the transparent toner layer and the colored toner image. The adhesive layer has hot-melt property.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
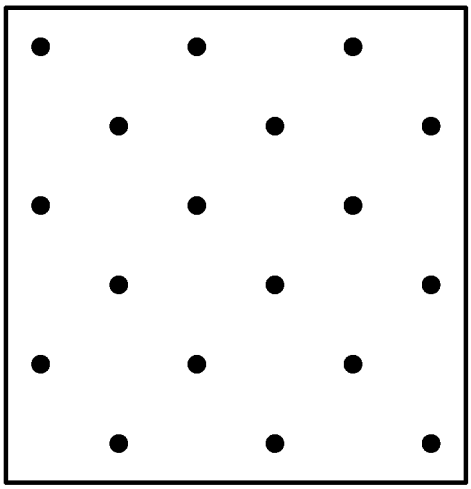
FIG. 1 is a conceptional view of a dot structure in accordance with area coverage modulation.
Figure 2:
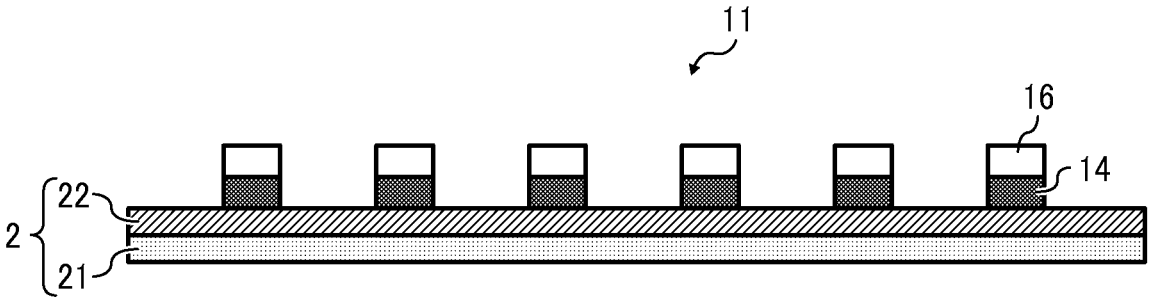
FIG. 2 RELATED ART
FIG. 2 is a cross-sectional view of a related-art transfer sheet.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

Figure 3:
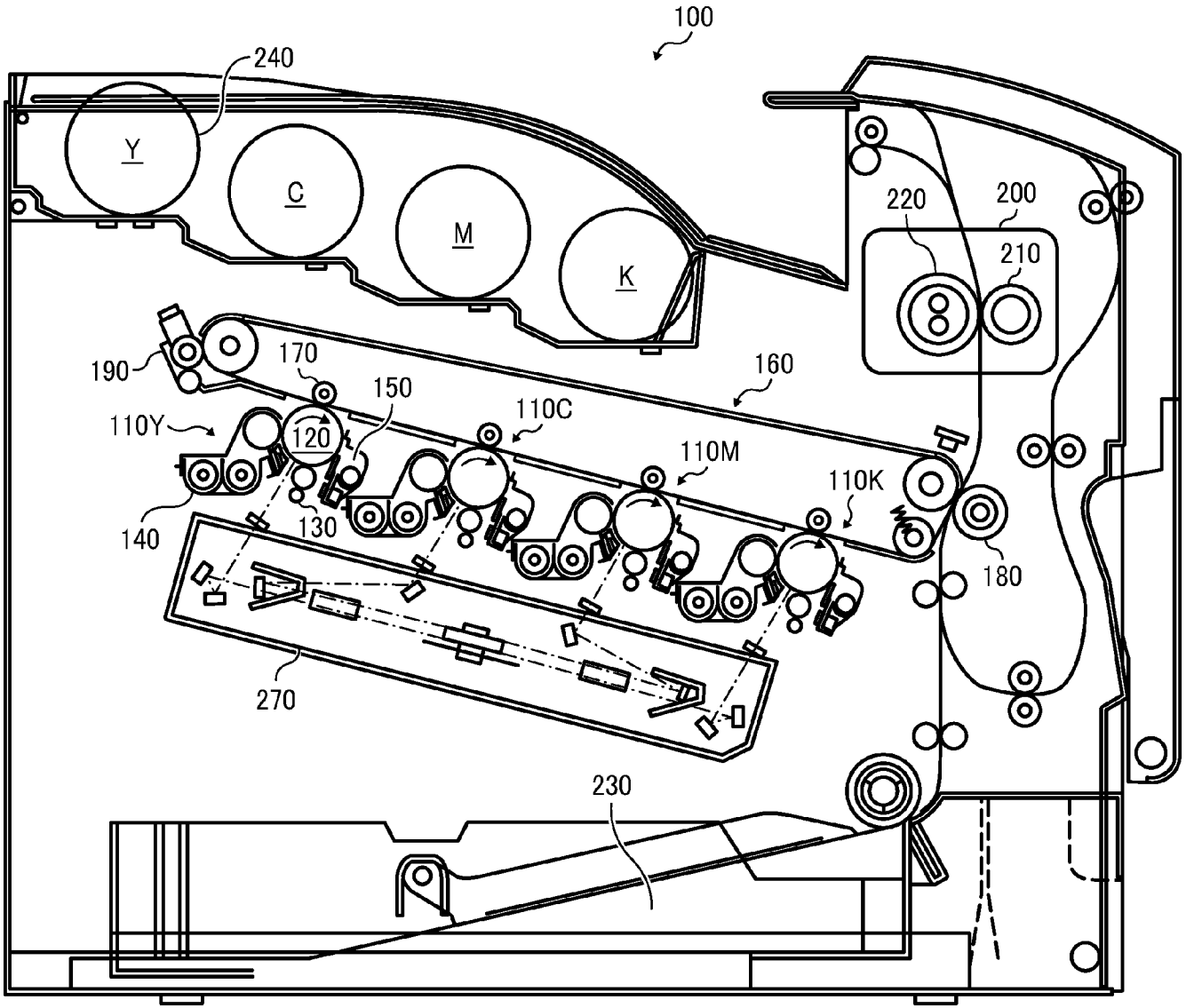
FIG. 3 is a schematic view of an image forming apparatus for executing a method of manufacturing transfer sheet according to an embodiment.

FIG. 3 is a schematic view of an image forming apparatus for executing the method according to an embodiment. An image forming apparatus 100 includes four imaging units 110Y, 110C, 110M, and 110B for forming images of yellow, cyan, magenta, and black, respectively, disposed in tandem. Since the imaging units 110Y, 110C, 110M, and 110B have the same configuration, the additional characters Y, C, M, and B representing toner colors of yellow, cyan, magenta, and black, respectively, are hereinafter added or omitted as appropriate.

Each of the imaging units 110 includes a photoreceptor 120. Around the photoreceptor 120, a charger 130 for charging the photoreceptor 120, a developing device 140 for developing a latent image formed on the photoreceptor 120 into a toner image, a lubricant applicator for applying a lubricant to the photoreceptor 120, a cleaner 150 for cleaning the photoreceptor 120 after image transfer are disposed. Above the four imaging units 110, an intermediate transfer belt 160 is disposed. The intermediate transfer belt 160 is an endless belt including a heat-resistant material, such as polyimide and polyamide, having a middle resistivity. The intermediate transfer belt 160 is stretched across multiple support rollers and is rotatable. Below the four imaging units 110, an irradiator 270 is disposed. The irradiator 270 is adapted to irradiate the charged surfaces of the photoreceptors 120 based on image information to form latent images thereon.

A primary transfer roller 170 is disposed facing the photoreceptor 120 with the intermediate transfer belt 160 therebetween. The primary transfer roller 170 is adapted to transfer a toner image from the photoreceptor 120 onto the intermediate transfer belt 160. The primary transfer roller 170 is connected to a power source that supplies a predetermined voltage to the primary transfer roller 170. A secondary transfer roller 180 is pressed against an outer surface of the intermediate transfer belt 160 facing one of the support rollers. The secondary transfer roller 180 is connected to a power source that supplies a predetermined voltage to the secondary transfer roller 180. A contact portion of the secondary transfer roller 180 with the intermediate transfer belt 160 defines a secondary transfer area in which a toner image is transferred from the intermediate transfer belt 160 onto a recording medium. An intermediate transfer belt cleaner 190 is disposed against an outer surface of the intermediate transfer belt 160 facing one of the support rollers. Above the secondary transfer area, a fixing device 200 is disposed. The fixing device 200 is adapted to almost permanently fix a toner image on a recording medium. The fixing device 200 includes a fixing roller 210 and a pressing roller 220 pressed against the fixing roller 210. The pressing roller 220 internally contains a halogen heater. The fixing roller 210 may be replaced with a heating roller internally containing a halogen heater or an endless fixing belt wound around a fixing roller. A paper feeder 230 is disposed at a lower part of the image forming apparatus 100. The paper feeder 230 is adapted to store a recording medium and to feed the recording medium toward the secondary transfer area. The paper feeder 230 includes a detachably attachable paper feed cassette.

The developing device 140 includes a developing sleeve disposed facing the photoreceptor 120. The developing sleeve internally contains a magnetic field generator. Below the developing sleeve, two screws are disposed. Each of the screws is adapted to mix magnetic carrier particles with toner particles supplied from a toner bottle 240 to prepare a developer and to supply the developer onto the developing sleeve. The thickness of the developer supplied onto the developing sleeve is regulated by a doctor blade. The developing sleeve moves in the same direction as the photoreceptor 120 at the position where the developing sleeve faces the photoreceptor 120 while bearing and conveying the developer so as to supply toner particles to a latent image formed on the photoreceptor 120.

The colored toner includes a binder resin and at least one of a black colorant, a yellow colorant, a magenta colorant, and a cyan colorant. The colored toner may optionally include other additives such as charge controlling agents, wax materials, fluidity improving particles, and antioxidants. The wax materials and fluidity improving particles may be added either internally or externally. The colored toner may be obtained by a physical method in which a mixture of the above raw materials are melt-kneaded, the kneaded mixture is pulverized into particles, and the particles are classified by size to collect desired-size particles.

Alternatively, the colored toner may be obtained by a chemical method such as a dry granulation method in which liquid droplets of a binder resin solution are dried into particles; a solidification granulation method in which aqueous medium is removed from an O/W emulsion; an emulsion aggregation method; a suspension polymerization method; and a liquid elongation method in which a polyester prepolymer is elongated. Physical and chemical methods may be used in combination.

Specific examples of usable yellow colorants include, but are not limited to, Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, Tartrazine Lake, and C. I. Pigment Yellow 180.

Specific examples of usable red colorants include, but are not limited to, Colcothar, Cadmium Red, Permanent Red 4R, Lithol Red, Pyrazolone Red, Watching Red Calcium Salt, Lake Red D, Brilliant Carmine 6B, Eosin Lake, Rhodamine Lake B, Alizarine Lake, Brilliant Carmine 3B, and C. I. Pigment Red 122. Specific examples of usable violet colorants include, but are not limited to, Fast Violet B and Methyl Violet Lake.

Specific examples of usable blue colorants include, but are not limited to, Cobalt Blue, Alkali Blue, Victoria Blue Lake, Phthalocyanine Blue, Metal-free Phthalocyanine Blue, Phthalocyanine Blue Partial Chloride, Fast Sky Blue, Indanthrene Blue BC, and C. I. Pigment Blue 15:3.

Specific examples of usable black colorants include, but are not limited to, azine dyes (e.g., Carbon Black, Oil Furnace Black, Channel Black, Lamp Black, Acetylene Black, Aniline Black), metal salt azo dyes, metal oxides, and complex metal oxides.

Two or more of these colorants can be used in combination.

In some embodiments, the colorant content in the colored toner is 1 to 15% by weight or 3 to 10% by weight. When the colorant content is less than 1% by weight, coloring power of the toner may be poor. When the colorant content is greater than 15% by weight, coloring power and electric property of the toner may be poor because the colorant cannot be uniformly dispersed in the toner.

The transparent toner comprises fine particles of a resin usable as the binder resin of the colored toner. Specific examples of such resins include, but are not limited to, polyester resins, polystyrene resins, polyacrylic resins, vinyl resins, polycarbonate resins, polyamide resins, polyimide resins, epoxy resins, and polyurea resins. The transparent toner is not necessarily comprised of the same binder resin as the colored toner so long as both the transparent toner and the colored toner are fusible under any fixing condition.

Image data to be transferred onto a target medium (e.g., cloth) may be input into an image forming apparatus, such as the image forming apparatus 100, from a personal computer. Alternatively, image data may be input into a personal computer from a scanner and subsequently into the image forming apparatus. Image data to be input into the image forming apparatus is 8-bit RGB data indicating the lightness of the primary colors of red, green, and blue with a scale of 0 to 255. The RGB data may be arbitrarily subjected to mirror image forming process, enhancement process by modulation transfer function (MTF) filter, color matching process, conversion process into CMYK color space data, gamma correction process, and pseudo-halftone process, and is converted into output image data. The output image data is transmitted to a controller and the irradiator 170 in the image forming apparatus 100, for example, so as to form a latent image and a toner image. The process of converting input image data into output image data may be performed either in a personal computer or in the image forming apparatus.

Figure 4:
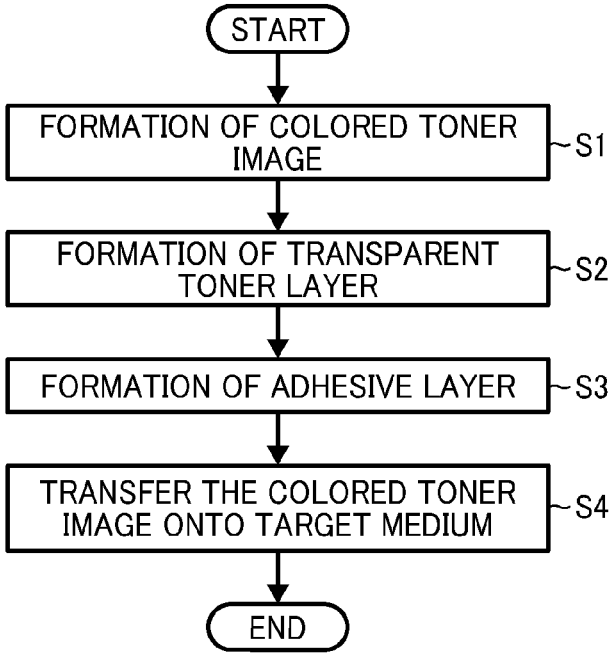
FIG. 4 is a flowchart of a method of manufacturing transfer sheet according to an embodiment.

FIG. 4 is a flowchart of a method of manufacturing transfer sheet according to an embodiment. In a step S1, a colored toner image 4 is formed on a release sheet 2. In a step S2, a transparent toner layer 5 is formed on an image area 40 that includes the colored toner image 4. In a step S3, an adhesive layer 6 is formed on the transparent toner layer 5. Thus, a transfer sheet 1 having the colored toner image 4 is formed. The adhesive layer 6 may be directly formed on a part of the colored toner image 4 on which the transparent toner layer 5 cannot be formed, for example, a small image part on edge portions of the colored toner image 4, so that the resulting transfer sheet 1 has strong adhesive force without contamination. In a step S4, the transfer sheet 1 transfers the colored toner image 4 onto a target medium 9.

Figure 5A:
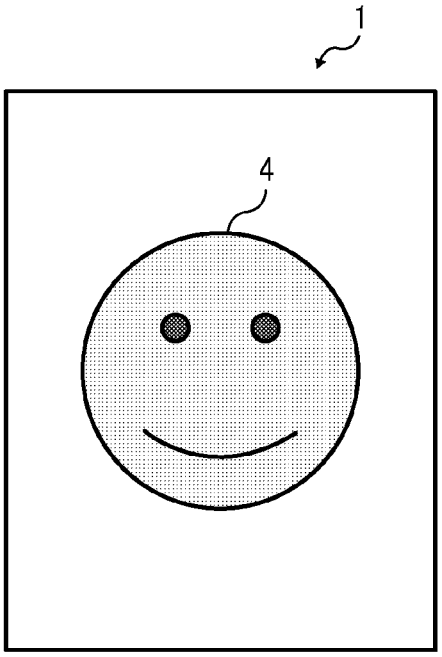
FIG. 5A and FIG. 5B are conceptional views for explaining colored toner image, image area, and non-image image area.
Figure 5B:
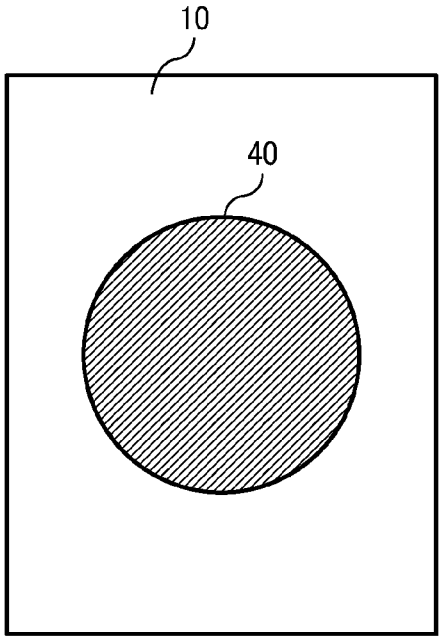

FIG. 5A and FIG. 5B are conceptional views for explaining the colored toner image 4, image area 40, and non-image image area 10. The image area 40 is defined by an area on which the colored toner image 4 is formed. When the colored toner image 4 formed from single or multiple colored toners, having a face-like shape, is formed as illustrated in FIG. 5A, the image area 40 is defined by an area on which the colored toner image 4 is formed as illustrated in FIG. 5B. Areas other than the image area 40 are defined as non-image image area 10.

Figure 6:
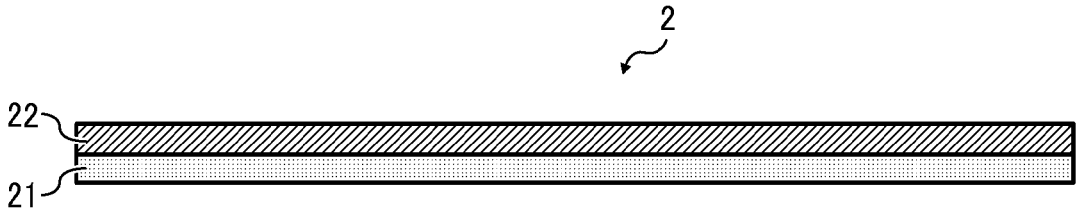
FIG. 6 is a cross-sectional view of a release sheet for use in a method according to an embodiment.

FIG. 6 is a cross-sectional view of the release sheet 2 for use in the method according to an embodiment. The release sheet 2 includes a sheet-like transparent PET film 21 and a release layer 22 including a silicone release agent. The release layer 22 is formed on a surface of the PET film 21. The release sheet 2 is not limited in its configuration and material so long as the release sheet 2 has surface releasability and an enough thickness for forming the colored toner image 4 thereon. Alternatively, the PET film 21 may be replaced with white coated paper, and the silicone release agent may be replaced with a fluorine-based release agent.

Figure 7:
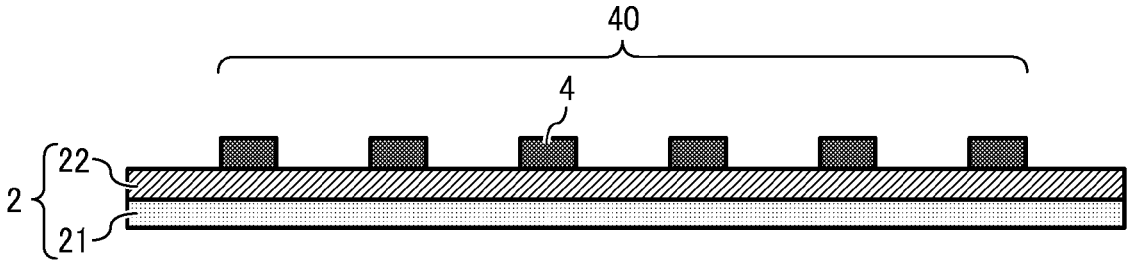
FIG. 7 is a cross-sectional view of the release sheet on which a colored toner image is formed in the method according to an embodiment.

FIG. 7 is a cross-sectional view of the release sheet 2 on which the colored toner image 4 is formed in the step S1. In the step S1, the image forming apparatus 100 forms the colored toner image 4 on the release layer 22 of the release sheet 2. In the present embodiment, the image forming apparatus 100 employs an electrophotographic color laser printer containing four colored toners of cyan, magenta, yellow, and black, as described above. A typical electrophotographic image forming apparatus is adapted to transfer a toner image onto a sheet-like recording medium based on input image data and to fix the toner image on the recording medium by application of heat and pressure. Thus, when the release sheet 2 is set in the paper feeder 230 and mirror image data of an objective image is input into the image forming apparatus 100 from a personal computer, the image forming apparatus 100 forms the colored toner image 4 on the release layer 22 of the release sheet 2 based on the input image data. The reason why the mirror image data of an objective image is input is that a side of the colored toner image 4 which is contacting the release layer 22 becomes a surface of the objective image after the resulting transfer sheet 1 is transferred onto the target medium 9. The image data may include high-lightness color formed with micro dots. The colored toner image 4 may be formed on the release sheet 2 by another image forming apparatus other than the image forming apparatus 100.

Figure 8:
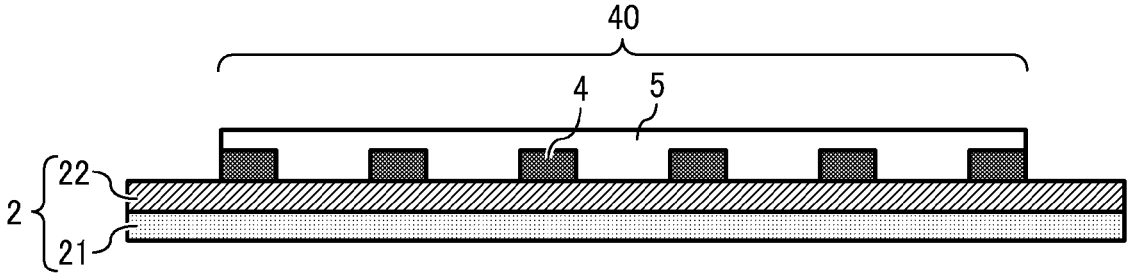
FIG. 8 is a cross-sectional view of the release sheet on which a transparent layer is formed in the method according to an embodiment.

FIG. 8 is a cross-sectional view of the release sheet 2 on which the transparent layer 5 is formed in the step S2. In the step S2, the transparent toner layer 5 is formed on the image area 40 including the colored toner image 4 on the release sheet 2. When forming the transparent toner layer 5, one of the imaging units 110 in the image forming apparatus 100 is replaced with another imaging unit containing a transparent toner. Alternatively, an imaging unit containing a transparent toner may be added to the image forming apparatus 100.

When minor image data in which input value for transparent color is set to 100% and that for other colors is set to 0% is input into the image forming apparatus 100, the transparent toner layer 5 is formed on the image area 40 including the colored toner image 4 on the release sheet 2, as illustrated in FIG. 8. In some embodiments, the colored toner image 4 and the transparent toner layer 5 are simultaneously formed by an image forming apparatus capable of simultaneously forming the colored toner image 4 and the transparent toner layer 5.

Figure 9:
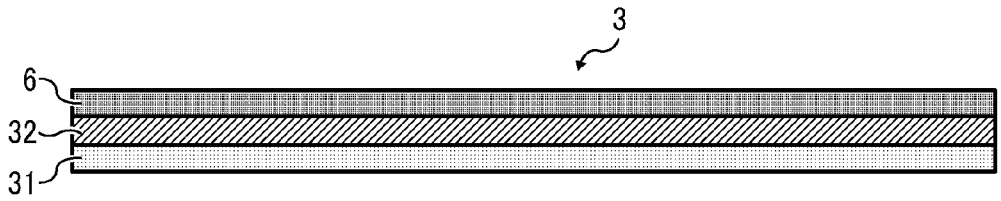
FIG. 9 is a cross-sectional view of an adhesive sheet for use in the method according to an embodiment.
Figure 10:
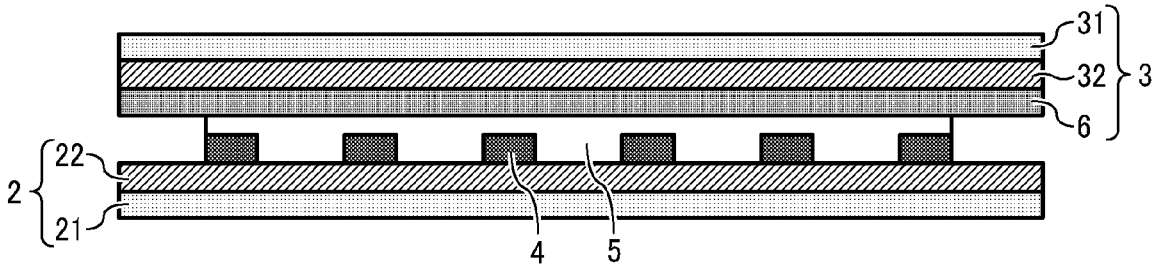
FIG. 10 is a cross-sectional view of the release sheet on which the adhesive sheet is superimposed in the method according to an embodiment.
Figure 11:
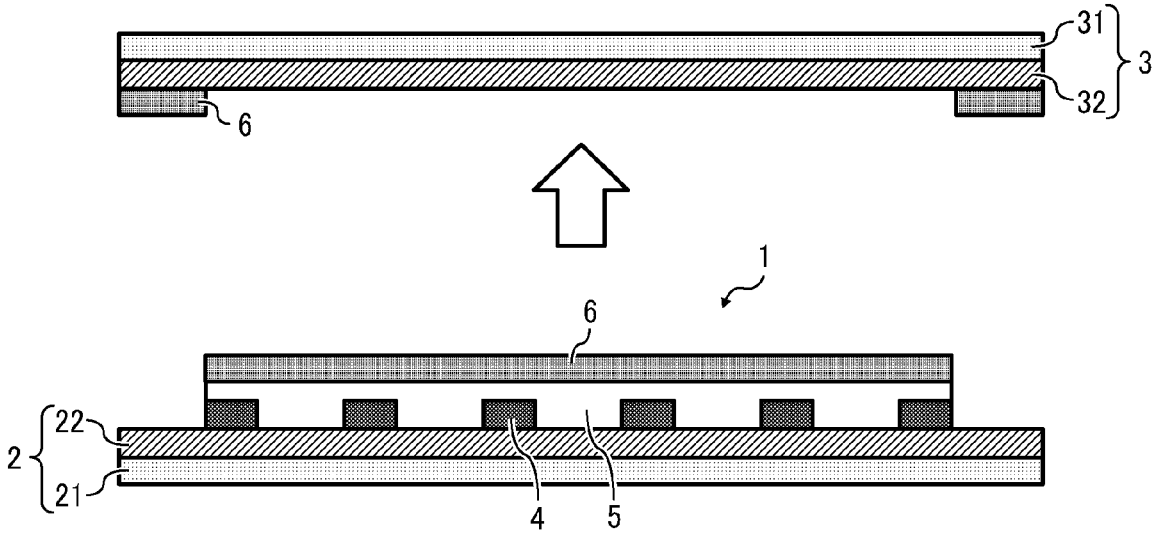
FIG. 11 is a cross-sectional view of the release sheet from which the adhesive sheet is separated in the method according to an embodiment.

In the step S3, the adhesive layer 6 is formed on the transparent toner layer 5 on the release sheet 2. FIG. 9 is a cross-sectional view of an adhesive sheet 3 for use in the method according to an embodiment. FIG. 10 is a cross-sectional view of the release sheet 2 on which the adhesive sheet 3 is superimposed in the step S3. FIG. 11 is a cross-sectional view of the release sheet 2 from which the adhesive sheet 3 is separated in the step S3.

Referring to FIG. 9, the adhesive sheet 3 includes a sheet-like transparent PET film 31 and a release layer 32 including a silicone release agent. The release layer 32 is formed on a surface of the PET film 31. The adhesive sheet 3 further includes the adhesive layer 6 formed on the release layer 32. The adhesive layer 6 does not express adhesive property at normal temperatures but does express adhesive property when melted by application of heat. The adhesive layer 6 may be comprised of polyester resin, acrylic resin, or urethane resin, for example.

In the step S3, as illustrated in FIG. 10, the adhesive layer 6 of the adhesive sheet 3 is pressed against the transparent toner layer 5 formed on the release sheet 2 upon application of heat so that the adhesive layer 6 and the transparent toner layer 5 get melted and bind to each other due to their adhesive properties.

Subsequently, as illustrated in FIG. 11, the adhesive sheet 3 is removed so that a part of the adhesive layer 6 binding to the transparent toner layer 5 is transferred onto the release sheet 2 while the other parts of the adhesive layer 6 not binding to the transparent toner layer 5 remains on the adhesive sheet 3. Thus, the transfer sheet 1 having the adhesive layer 6 on the image area 40 is obtained.

Because the transparent toner layer 5 is formed on the entire image area 40, not only on the colored toner image 4, the adhesive layer 6 binds to the transparent toner layer 5 at a wide contact area even when the colored toner image 4 is a high-lightness image formed of micro dots. Therefore, the adhesive layer 6 binds to the transparent toner layer 5 with an improved adhesive force. Because the adhesive layer 6 not binding to the transparent toner layer 5 remains on the adhesive sheet 3, the transfer sheet 1 includes no adhesive layer 6 on the non-image image area 10.

Figure 12:
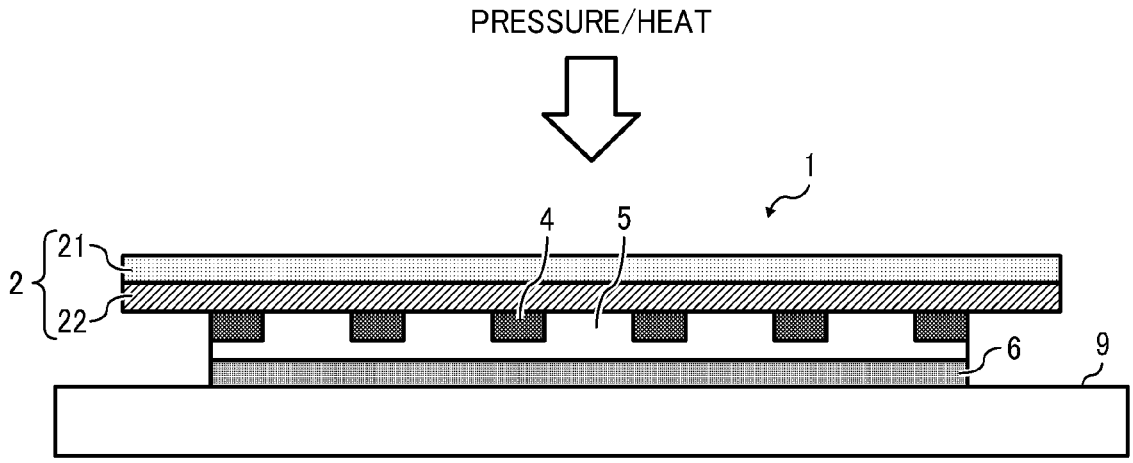
FIG. 12 is a cross-sectional view of a transfer sheet according to an embodiment pressed against a target medium.
Figure 13:
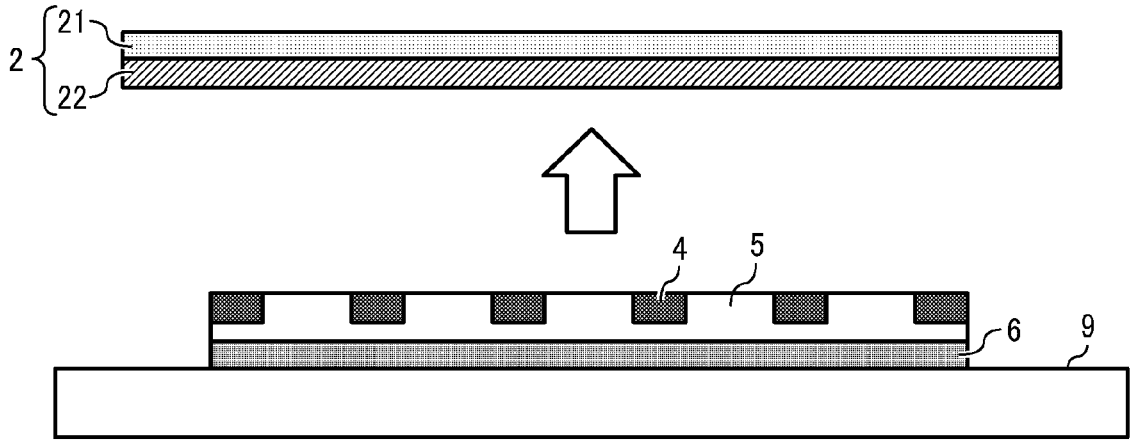
FIG. 13 is a cross-sectional view of the target medium onto which the colored toner image is transferred.

In the step S4, the transfer sheet 1 transfers the colored toner image 4 onto the target medium 9. FIG. 12 is a cross-sectional view of the transfer sheet 1 pressed against the target medium 9. FIG. 13 is a cross-sectional view of the target medium 9 onto which the colored toner image 4 is transferred.

In the step S4, as illustrated in FIG. 12, the adhesive layer 6 of the transfer sheet 1 is pressed against the target medium 9 upon application of heat.

Subsequently, as illustrated in FIG. 13, the release sheet 2 is removed so that the adhesive layer 6, the transparent toner layer 5, and the colored toner image 4 are transferred onto the target medium 9. Because the adhesive layer 6 is formed on the entire image area 40, not only on the colored toner image 4, the adhesive layer 6 binds to the target medium 9 with an improved adhesive force, resulting in reliable transfer of the colored toner image 4 onto the target medium 9.

Because both the transparent toner layer 5 and the adhesive layer 6 are transparent, color tone of the colored toner image 4 is not disturbed. The target medium 9 may be a material such as cloth, ceramic, fabric, plastic, paper, wood, leather, glass, and metal.

According to the present embodiment, the colored toner image 4 is formed on the release sheet 2 and the transparent toner layer 5 is further formed on the image area 40 including the colored toner image 4. Within the image area 40, the colored toner image 4 is formed of dots and spaces between the dots are filled with the transparent toner layer 5. Because the adhesive layer 6 has hot-melt property, a part of the adhesive layer 6 which is in contact with the transparent toner layer 5 binds to the transparent toner layer 5 upon application of heat. By contrast, the other part of the adhesive layer 6 which is in contact with the non-image image area 10, having no transparent toner layer 5 thereon, is removed without binding to any part of the release sheet 2. Thus, the resulting transfer sheet 1 has the adhesive layer 6 only on the image area 40.

Because the spaces between the dots forming the colored toner image 4 are filled with the transparent toner layer 5, the adhesive layer 6 binds to the transparent toner layer 5 at a wide contact area even when the colored toner image 4 is a high-lightness image formed of micro dots. Compared to a case in which the adhesive layer 6 is directly formed on the colored toner image 4 without forming the transparent toner layer 5, the adhesive layer 6 can more strongly bind to the transparent toner layer 5. Also, the adhesive layer 6 can more strongly bind to the target medium 9 owing to its large area, resulting in reliable transfer of the colored toner image 4 onto the target medium 9.

Figure 14:
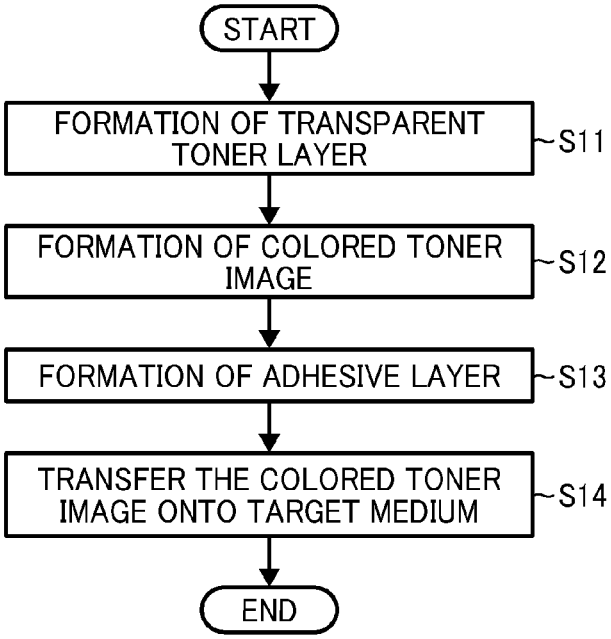
FIG. 14 is a flowchart of a method of manufacturing transfer sheet according to another embodiment.

FIG. 14 is a flowchart of a method of manufacturing transfer sheet according to another embodiment. In the present embodiment, the step for forming the colored toner image 4 and the step for forming the transparent toner layer 5 are executed in a different order from the embodiment described above.

In a step S11, a transparent toner layer 5 is formed on a release sheet 2. In a step S12, a colored toner image 4 is formed on the transparent toner layer 5. In a step S13, an adhesive layer 6 is formed on the transparent toner layer 5 and the colored toner image 4. Thus, a transfer sheet 1 having the colored toner image 4 is formed. In a step S14, the transfer sheet 1 transfers the colored toner image 5 onto a target medium 9. The release sheet 2 may have the same configuration as that in Example 1.

Figure 15:
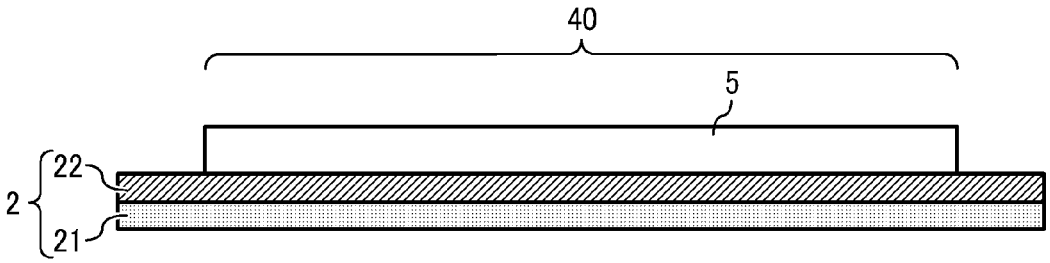
FIG. 15 is a cross-sectional view of the release sheet on which a transparent toner layer is formed in the method according to an embodiment.

FIG. 15 is a cross-sectional view of the release sheet 2 on which the transparent toner layer 5 is formed in the step S11. In the step S11, the transparent toner layer 5 is formed on an image area 40, within which the colored toner image 4 is to be formed, on the release layer 22 of the release sheet 2. The image area 40 is defined by objective image data. In a similar manner to the step S2, the image forming apparatus 100 forms the transparent toner layer 5 on the image area 40 on the release sheet 2.

Figure 16:
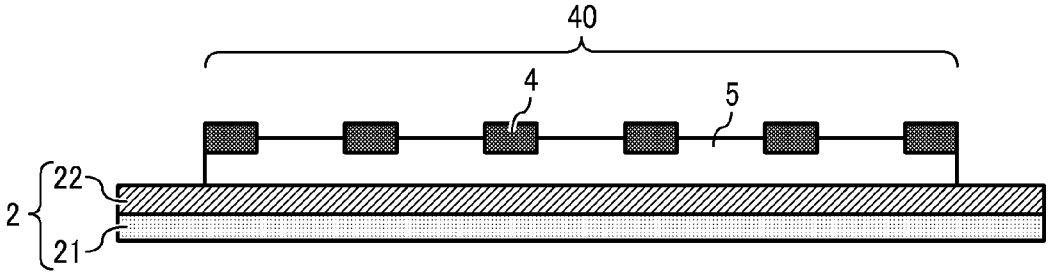
FIG. 16 is a cross-sectional view of the release sheet on which a colored toner image is formed on the transparent toner layer in the method according to an embodiment.

FIG. 16 is a cross-sectional view of the release sheet 2 on which the colored toner image 4 is formed on the transparent toner layer 5 in the step S12. In the step S12, the colored toner image 4 is formed on the transparent toner layer 5 formed on the image area 40 on the release sheet 2. In a similar manner to the step 1, when the release sheet 2 having the transparent toner layer 5 thereon is set in the paper feeder 230 and mirror image data of an objective image is input into the image forming apparatus 100 from a personal computer, the image forming apparatus 100 forms the colored toner image 4 on the image area 40 on which the transparent toner layer 5 is formed.

Figure 17:
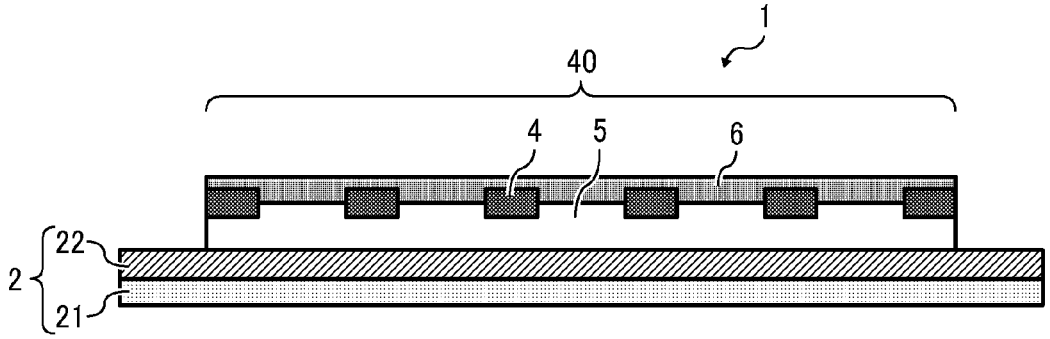
FIG. 17 is a cross-sectional view of the release sheet on which an adhesive layer is formed in the method according to an embodiment.

FIG. 17 is a cross-sectional view of the release sheet 2 on which the adhesive layer 6 is formed in the step S13. In the step S13, the adhesive layer 6 is formed on the colored toner image 4 and the transparent toner layer 5 formed on the release sheet 2. The adhesive layer 6 is formed by pressing the adhesive layer 6 of the adhesive sheet 3 against the release sheet 2 upon application of heat in a similar manner to the step S3. A part of the adhesive layer 6 which is in contact with the colored toner image 4 or the transparent toner layer 5 is transferred onto the colored toner image 4 or the transparent toner layer 5 due to its binding force to toner. As a result, the transfer sheet 1 having the adhesive layer 6 on the entire image area 40 is obtained, as illustrated in FIG. 17.

Because the spaces between the dots forming the colored toner image 4 are filled with the transparent toner layer 5, the adhesive layer 6 reliably binds to either the colored toner image 4 or the transparent toner layer 5 even when the colored toner image 4 is a high-lightness image formed of micro dots.

Figure 18:
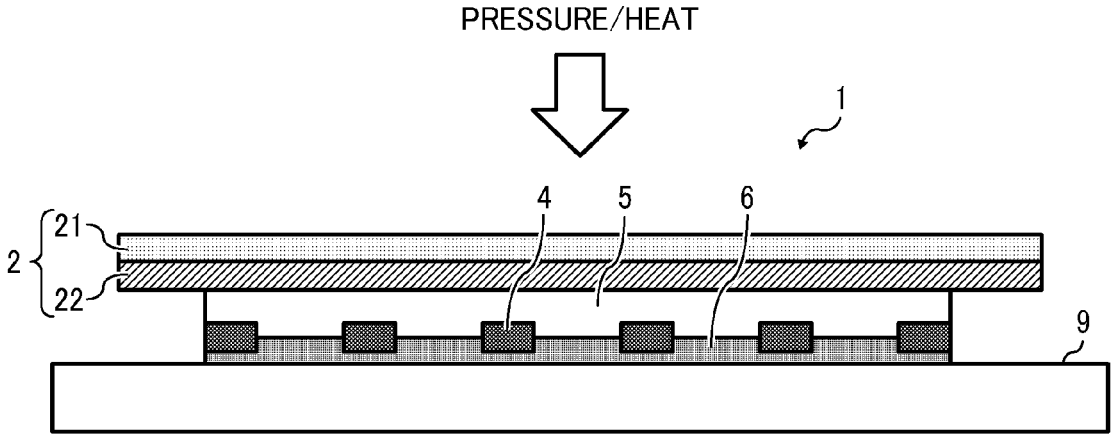
FIG. 18 is a cross-sectional view of a transfer sheet according to an embodiment pressed against a target medium.
Figure 19:
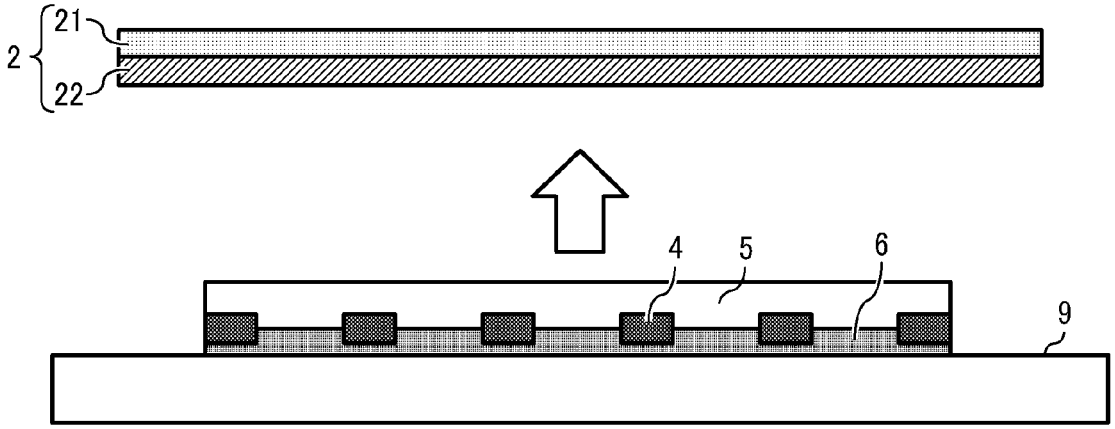
FIG. 19 is a cross-sectional view of the target medium on which the colored toner image is transferred.

FIG. 18 is a cross-sectional view of the transfer sheet 1 pressed against the target medium 9. FIG. 19 is a cross-sectional view of the target medium 9 on which the colored toner image 4 is transferred.

In the step S14, the transfer sheet 1 transfers the colored toner image 4 onto the target medium 9. As illustrated in FIG. 18, first, the adhesive layer 6 of the transfer sheet 1 is pressed against the target medium 9 upon application of heat.

Subsequently, as illustrated in FIG. 19, the release sheet 2 is removed so that the adhesive layer 6, the transparent toner layer 5, and the colored toner image 4 are transferred onto the target medium 9. Because the adhesive layer 6 is formed on the entire image area 40 including the transparent toner layer 5, not only on the colored toner image 4, the adhesive layer 6 binds to the target medium 9 with an improved adhesive force, resulting in reliable transfer of the colored toner image 4 onto the target medium 9.

According to the present embodiment, the transparent toner layer 5 is formed on the image area 40 on the release sheet 2 and the colored toner image 4 is further formed on the transparent toner layer 5. Within the image area 40, the colored toner image 4 is formed of dots and spaces between the dots are filled with the transparent toner layer 5. Therefore, the adhesive layer 6 reliably binds to either the transparent toner layer 5 or the colored toner image 4 even when the colored toner image 4 is a high-lightness image formed of micro dots, resulting in reliable transfer of the colored toner image 4 onto the target medium 9. Since the colored toner image 4 is formed on the transparent toner layer 5 in the transfer sheet 1, the colored toner image 4 transferred onto the target medium 9 is covered with the transparent toner layer 5. Thus, the colored toner image 4 can be protected from external damage.

According to another embodiment, the transparent toner layer 5 is formed only on a part of the image area 40 at which toner area ratio equals or falls below a predetermined value. In this embodiment, the step for forming the transparent toner layer 5 includes a process of calculating toner area ratio, a process of determining whether transparent toner layer is to be formed or not, and a process of forming transparent toner layer.

In the process of calculating toner area ratio, toner area ratio is calculated based on signal values of image data of the colored toner image 4. When a resulting image is formed from four colors of cyan, magenta, yellow, and black, image data of the colored toner image 4 is converted into signal values of Vc, Vm, Vy, and Vk for cyan, magenta, yellow, and black, respectively, each normalized into a numeral of 0 to 1. Toner area ratio S is calculated from the following formula:

$$S = Vc + Vm + Vy + Vk - (Vc \times Vm + Vm \times Vy + Vy \times Vk + Vk \times Vc) + (Vc \times Vm \times Vy + Vm \times Vy \times Vk + Vy \times Vk \times Vc + Vk \times Vc \times Vm) - Vc \times Vm \times Vy \times Vk$$

In low-lightness color, each signal value is relatively large and therefore the toner area ratio S is relatively large. In high-lightness color, each signal value is relatively small and therefore the toner area ratio S is relatively small.

In the process of determining whether transparent toner layer is to be formed or not, such determination is made for each pixel based on the toner area ratio S of the colored toner image 4. In the present embodiment, determination is made such that transparent toner layer is to be formed on a pixel having a toner area ratio of 0.8 or less and transparent toner layer is not to be formed on a pixel having a toner area ratio greater than 0.8. Accordingly, the transparent toner layer 5 is to be formed on a low-lightness color portion having a small toner area ratio while no transparent toner layer is to be formed on a high-lightness color portion having a large toner area ratio. The threshold for determining whether transparent toner layer is to be formed or not is not limited to the toner area ratio of 0.8 so long as even high-lightness color images can be reliably transferred onto the target medium 9.

In the process of forming transparent toner layer, the transparent toner layer 5 is formed on pixels on which transparent toner layer is determined to be formed. The transparent toner layer 5 is formed in the same manner as the embodiments described above.

The colored toner image 4 is formed in the same manner as the embodiments described above.

Figure 20:
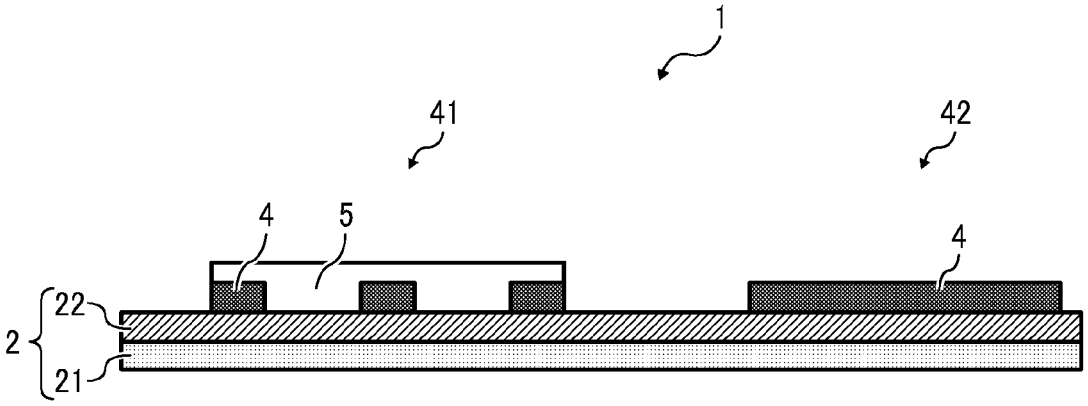
FIG. 20 is a cross-sectional view of the release sheet on which a colored toner image having a high-lightness color portion and a low-lightness color portion is formed.

FIG. 20 is a cross-sectional view of the release sheet 2 on which the colored toner image 4 having a high-lightness color portion 41 and a low-lightness color portion 42 is formed. In the present embodiment, the transparent toner layer 5 is formed on the high-lightness color portion 41 having a small toner area ratio filling the spaces between the dots, but is not formed on the low-lightness color portion 42 having a large toner area ratio, as illustrated in FIG. 20. The adhesive layer 6, having hot-melt property, contacts the transparent toner layer 5 formed on the high-lightness color portion 41 with a wide contact area. Therefore, the adhesive layer 6 can be reliably formed over the high-lightness color portion 41.

The adhesive layer 6 also directly contacts the low-lightness color portion 42, having a large toner area ratio, with a wide contact area. Therefore, the adhesive layer 6 can be also reliably formed over the low-lightness color portion 42.

Because the transparent toner layer 5 is not formed on the low-lightness color portion 42, consumption of transparent toner can be reduced, resulting in cost reduction.

According to another embodiment, the colored toner image 4 is formed based on image data pseudo-halftone-processed by a line screen tone dither method. In the line screen tone dither method, dots are developed into lines and the thicknesses of the lines are varied so as to express gradation. Compared to a dot tone dither method expressing gradation by varying the sizes of dots, the line screen tone dither method is more unlikely to produce micro-area dot. Therefore, the adhesive layer 6 is more likely to adhere to images formed by the line screen tone dither method. Accordingly, an objective toner image is more reliably transferred onto the target medium 9. In the present embodiment, the threshold for determining whether transparent toner layer is to be formed or not can be more reduced, resulting in consumption reduction of transparent toner.

Input image data, such as gradation image data (e.g., photograph), has 8 to 12 bit multivalued data per pixel. On the other hand, the image forming apparatus 100 substantially has a very small numbers of gradation levels which can be reproduced by one pixel. Therefore, resolution of the image forming apparatus 100 is improved to 600 dpi or 1,200 dpi so that a pseudo-halftone image is displayed by areally modulating image density with multiple pixels. In particular, gradation is expressed by controlling dot number (dot density) per unit area. The above-described process in which input image data is converted into a pseudo-halftone image is called as a pseudo-halftone process. Dither methods are of the pseudo-halftone processes. Dither methods include ordered dither methods and random dither methods. In ordered dither methods, a submatrix (dither matrix) including n×n thresholds is overlapped on an input image and grayscale level of each pixel and corresponding threshold is compared. When the grayscale level is greater than the threshold, a numeral 1 is displayed. When the grayscale level is smaller than the threshold, a numeral 2 is displayed. After processing the n×n pixels, the dither matrix is transferred onto next n×n pixels and the same process is executed. This operation is repeated until the all pixels are processed. In random dither methods, the threshold is set by generating a random number in each pixel of an input image.

A pseudo-halftone image processed by an ordered dither method has a more periodical image structure. Dither matrices include dot screen types, Bayer types, and line screen types. In a dot screen type dither matrix, pixels are sequentially growing in a planer direction in the order of distance from a center pixel from nearest to farthest as image density increases. In a Bayer type dither matrix, each pixel is arranged as far as possible from each other. In a line screen type dither matrix, pixels are sequentially growing in the order of distance from a virtual center line from nearest to farthest.

Figure 21:
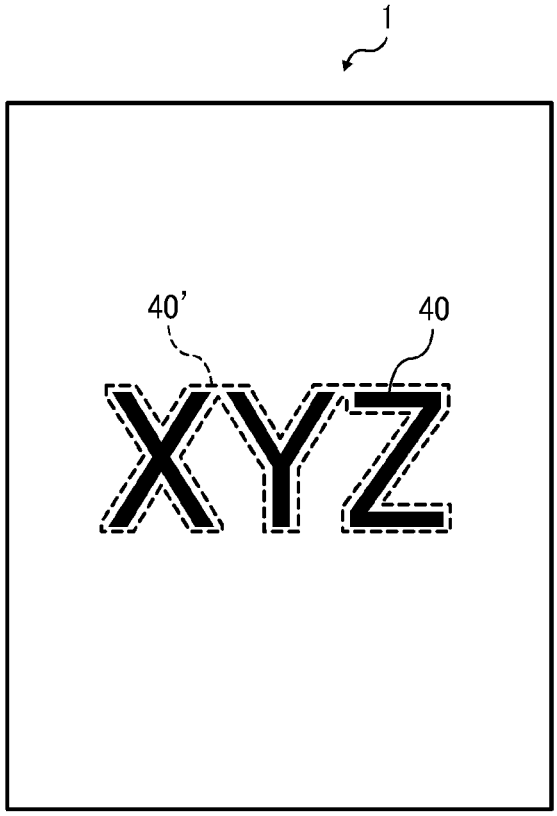
FIG. 21 is a conceptional view for explaining magnified image area.

According to another embodiment, the transparent toner layer 5 is formed on a magnified image area 40'. FIG. 21 is a conceptional view for explaining the magnified image area 40'. The magnified image area 40' is defined by magnifying the image area 40 within which the colored toner image 4 is formed. In the present embodiment, the magnified image area 40' is defined by displacing the boundary of the image area 40 one millimeter outward. The displacement width is not limited to one millimeter and is arbitrary set in accordance with image data or the target medium 9.

In the present embodiment, the transparent toner layer 5 is formed on the magnified image area 40'. The transparent toner layer 5 is formed in the same manner as the embodiments described above.

In the present embodiment, as described above, the transparent toner layer 5 is formed on the magnified image area 40'. Thus, the adhesive layer 6 contacts the transparent toner layer 5 with a wide contact area. Therefore, the adhesive layer 6 can be reliably formed over the image area 40 even when the colored toner image 4 is a high-lightness image formed of micro dots. Also, the adhesive layer 6 can more strongly bind to the target medium 9 owing to its large area, resulting in reliable transfer of the colored toner image 4 onto the target medium 9. Moreover, after the image area 40 is transferred onto the target medium 9, edge portions of the image area 40 is prevented from peeling off because of being covered with the transparent toner layer 5.

According to another embodiment, the transparent toner layer 5 is formed on an edge portion of the image area 40. The edge portion of the image area 40 is defined based on image data of the colored toner image 4. The edge portion of the image area 40 can be extracted by applying an edge extraction filter to the image data, for example. In the present embodiment, the edge portion of the image area 40 is defined by making the extracted edge portion one millimeter thicker.

In the present embodiment, the transparent toner layer 5 is formed on the edge portion. The transparent toner layer 5 is formed in the same manner as the embodiments described above.

In the present embodiment, as described above, the transparent toner layer 5 is formed on the edge portion. Thus, the adhesive layer 6 can be formed over the entire image area 40 with a wider contact area. The resulting transfer sheet 1 can reliably transfer the colored toner image 4 onto the target medium 9. Moreover, after the image area 40 is transferred onto the target medium 9, edge portions of the image area 40 is prevented from peeling off because of being covered with the transparent toner layer 5. Because the transparent toner layer 5 is not formed on the image area 40 other than the edge portion, consumption of transparent toner can be reduced, resulting in cost reduction.

According to another embodiment, the transparent toner layer 5 is formed on a transparent toner layer forming area designated by a user. The transparent toner layer forming area is defined by setting an input value for an area on which the user wishes to form transparent toner layer to 100%. In the present embodiment, the transparent toner layer 5 is formed on the transparent toner layer forming area. The transparent toner layer 5 is formed in the same manner as the embodiments described above.

In the present embodiment, as described above, the transparent toner layer 5 is formed on the transparent toner layer forming area designated by a user. The user is allowed to designate an area on which the transparent toner layer 5 is to be formed based on conditions observed in the transfer sheet or target medium. Therefore, it is possible to form the transparent toner layer 5 on a portion which is relatively difficult to transfer, such as a high-lightness color portion formed of micro dots, so that even such portions can be reliably transferred onto the target medium 9.

Figure 22:
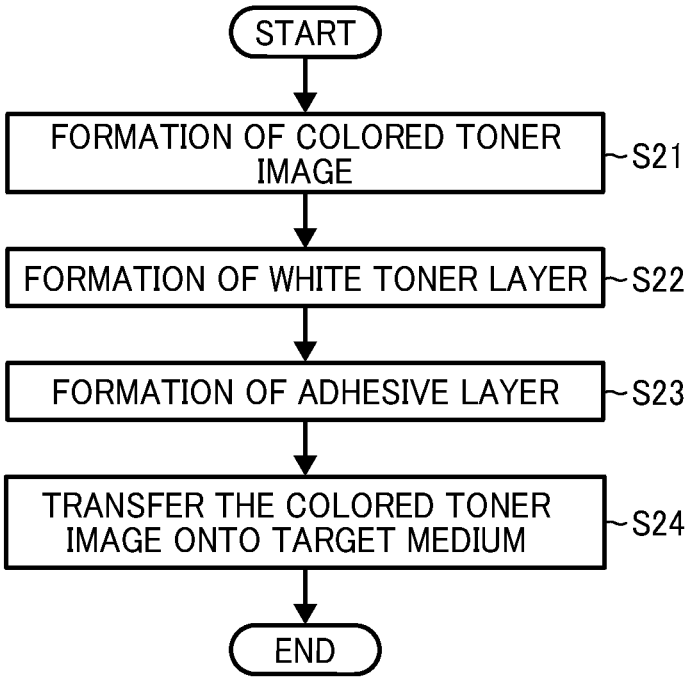
FIG. 22 is a flowchart of a method of manufacturing transfer sheet according to another embodiment.

According to another embodiment, the transparent toner is replaced with a white toner which uniformly reflects visible-wavelength light. FIG. 22 is a flowchart of a method of manufacturing transfer sheet according to another embodiment. In a step S21, a colored toner image 4 is formed on a release sheet 2. In a step S22, a white toner layer 7 is formed on an image area 40 that includes the colored toner image 4. In a step S23, an adhesive layer 6 is formed on the white toner layer 7. Thus, a transfer sheet 1 having the colored toner image 4 is formed. In a step S24, the transfer sheet 1 transfers the colored toner image 4 onto a target medium 9. The steps S21 to S24 are executed in the same manner as the embodiments described above except for replacing the transparent toner with the white toner.

Figure 23:
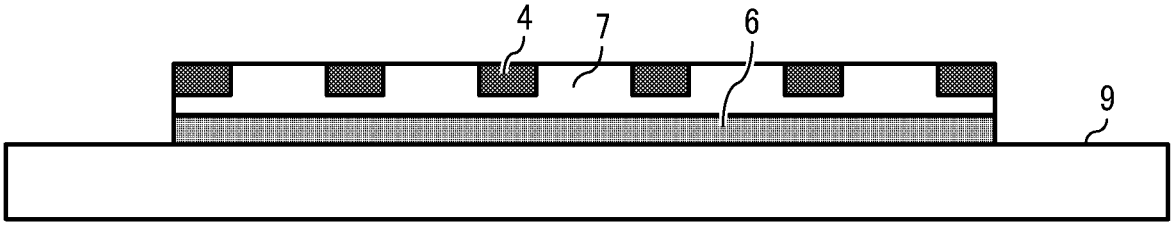
FIG. 23 is a cross-sectional view of a target medium onto which the colored toner image is transferred.

FIG. 23 is a cross-sectional view of the target medium 9 onto which the colored toner image 4 is transferred. As illustrated in FIG. 23, the white toner layer 7 is disposed between the target medium 9 and the colored toner image 4. Therefore, the colored toner image 4 is not disturbed by the color of the target medium 9. Thus, the transfer sheet 1 according to the present embodiment precisely reproduces colors of the colored toner image 4 even when the target medium 9 has a color other than white.

The white toner includes a binder resin and a white colorant, and optionally includes a charge controlling agent, a release agent, and other additives. Specific examples of usable binder resins include, but are not limited to, polyester resins, styrene resins, vinyl resins, ethylene resins, rosin-modified resins, acrylic resins, polyamide resins, and epoxy resins. Specific examples of usable white colorants include, but are not limited to, silica, alumina, titanium oxide, zinc oxide, tin oxide, quartz sand, clay, diatom earth, antimony trioxide, magnesium oxide, zirconium oxide, barium sulfate, barium carbonate, and calcium carbonate. Two or more of these materials can be used in combination.

Additional modifications and variations in accordance with further embodiments of the present invention are possible in light of the above teachings. It is therefore to be understood that within the scope of the appended claims the invention may be practiced other than as specifically described herein.

What is claimed is:

1. A method of manufacturing a transfer sheet, comprising:

forming a colored toner image on a sheet base material based on objective image data, the sheet base material having releasability;

defining an image area on the sheet base material based on the objective image data, the image area including the colored toner image;

forming a transparent toner layer on the image area; and forming an adhesive layer on the transparent toner layer, the adhesive layer having hot-melt property, wherein the colored toner image is formed of dots and spaces, in which between the dots and spaces are filled with the transparent toner layer.

2. The method according to claim 1, further comprising:

calculating a toner area ratio, the toner area ratio being a relationship between the image area and a non-image area, wherein, in forming the transparent toner layer, the transparent toner layer is formed only on a part of the image area at which the toner area ratio equals or falls below a set value.

3. The method according to claim 2, wherein the objective image data is pseudo-halftone data calculated by a line screen tone dither method.

4. The method according to claim 1, further comprising:

defining a magnified image area, wherein, in forming the transparent toner layer, the transparent toner layer is formed on the magnified image area.

5. The method according to claim 1, further comprising:

defining an edge potion of the image area based on the objective image data, wherein, in forming the transparent toner layer, the transparent toner layer is formed on the edge potion of the image area.

6. The method according to claim 1, further comprising:

defining a transparent toner layer forming area by a user, wherein, in forming the transparent toner layer, the transparent toner layer is formed on the transparent toner layer forming area.

7. The method according to claim 1, wherein the forming an adhesive layer includes:

pressing an adhesive sheet having the adhesive layer against the transparent toner layer upon application of heat so that the adhesive layer is transferred onto and fixed on the transparent toner layer; and removing the adhesive sheet.

8. The method according to claim 1, wherein, in the forming a colored toner image and in the forming a transparent toner layer, the colored toner image and the transparent toner layer are formed by an image forming apparatus.

9. A method of manufacturing a transfer sheet, comprising:

defining an image area on a sheet base material based on objective image data, the sheet base material having releasability;

forming a transparent toner layer on the image area;

forming a colored toner image on the transparent toner layer based on the objective image data; and forming an adhesive layer on the transparent toner layer and the colored toner image, the adhesive layer having hot-melt property, wherein the colored toner image is formed of dots and spaces, in which between the dots and spaces are filled with the transparent toner layer.

10. The method according to claim 9, further comprising:

calculating a toner area ratio, the toner area ratio being a relationship between the image area and a non-image area, wherein, in forming the transparent toner layer, the transparent toner layer is formed only on a part of the image area at which the toner area ratio equals or falls below a predetermined value.

11. The method according to claim 10, wherein the objective image data is pseudo-halftone data calculated by a line screen tone dither method.

12. The method according to claim 9, further comprising:

defining a magnified image area by magnifying the image area, wherein, in forming the transparent toner layer, the transparent toner layer is formed on the magnified image area.

13. The method according to claim 9, further comprising:

defining an edge potion of the image area based on the objective image data, wherein, in forming the transparent toner layer, the transparent toner layer is formed on the edge potion of the image area.

14. The method according to claim 9, further comprising:

defining a transparent toner layer forming area by a user, wherein, in forming the transparent toner layer, the transparent toner layer is formed on the transparent toner layer forming area.

15. A method of manufacturing a transfer sheet, comprising:

forming a colored toner image on a sheet base material based on objective image data, the sheet base material having releasability;

defining an image area on the sheet base material based on the objective image data;

forming a white toner layer on the image area; and forming an adhesive layer on the white toner layer, the adhesive layer having hot-melt property, wherein the colored toner image is formed of dots and spaces, in which between the dots and spaces are filled with the white toner layer.

16. The method according to claim 15, wherein the forming an adhesive layer includes:

pressing an adhesive sheet having the adhesive layer against the white toner layer upon application of heat so that the adhesive layer is transferred onto and fixed on the white toner layer; and removing the adhesive sheet.

17. The method according to claim 15, wherein, in forming the colored toner image and in forming the white toner layer, the colored toner image and the white toner layer are formed by an image forming apparatus.

* * * * *